US012313065B2

(12) United States Patent
Jeun et al.

(10) Patent No.: US 12,313,065 B2
(45) Date of Patent: May 27, 2025

(54) BACK PRESSURE REGULATING VALVE AND AN ELECTRIC TYPE OF A SCROLL COMPRESSOR WITH THE SAME

(71) Applicant: ATECHELTHERMO Co., Ltd., Anseong-si (KR)

(72) Inventors: Sung-Hyun Jeun, Seoul (KR); Byung-Il Jeun, Seoul (KR); Hyun-Jin Kim, Seoul (KR)

(73) Assignee: AT THERMO CO., LTD., Anseong-si (KR)

( * ) Notice: Subject to any disclaimer, the term of this patent is extended or adjusted under 35 U.S.C. 154(b) by 119 days.

(21) Appl. No.: 18/241,195

(22) Filed: Aug. 31, 2023

(65) Prior Publication Data

US 2025/0075701 A1 Mar. 6, 2025

(51) Int. Cl.
*F04C 18/02* (2006.01)
*F04C 29/00* (2006.01)

(52) U.S. Cl.
CPC ..... *F04C 18/0215* (2013.01); *F04C 29/0028* (2013.01)

(58) Field of Classification Search
CPC ..... F04C 18/0215; F04C 27/005–006; F04C 29/0021; F04C 29/0028
See application file for complete search history.

(56) References Cited

U.S. PATENT DOCUMENTS

| | | | | |
|---|---|---|---|---|
| 9,133,845 | B2 * | 9/2015 | Kim | F04C 27/005 |
| 2010/0158710 | A1 * | 6/2010 | Umemura | F04C 18/0215 417/310 |
| 2014/0134032 | A1 * | 5/2014 | Tozawa | F04C 29/0057 418/55.3 |
| 2019/0040860 | A1 * | 2/2019 | Heckt | F04C 28/12 |
| 2019/0211828 | A1 * | 7/2019 | Teshima | F04C 29/04 |
| 2020/0232466 | A1 * | 7/2020 | Kim | F04C 29/126 |

FOREIGN PATENT DOCUMENTS

| | | | | |
|---|---|---|---|---|
| KR | 20140036561 | A * | 3/2014 | |
| KR | 20210123446 | A * | 10/2021 | |
| WO | 2010064537 | A1 | 6/2010 | |
| WO | WO-2018221229 | A1 * | 12/2018 | F04C 18/02 |

* cited by examiner

*Primary Examiner* — Thomas Fink
(74) *Attorney, Agent, or Firm* — CANTOR COLBURN LLP

(57) ABSTRACT

Provided is a back pressure regulating valve and an electric type of a scroll compressor with the same. A valve of an electric scroll compressor for regulating a back pressure includes a valve housing including a first housing 11, a second housing and a communicating passage 13 for connecting the first housing 11 to the second housing 12; and a piston 14 including a first piston 141 located within the first housing 11, a second piston located within the second housing 12 and a connecting rod 143 for connecting the first piston 141 to the second piston 142, wherein the piston 14 is configured to move up and down within the first and the second housing 11, 12.

6 Claims, 7 Drawing Sheets

BACK PRESSURE REGULATING VALVE AND AN ELECTRIC TYPE OF A SCROLL COMPRESSOR WITH THE SAME

BACKGROUND OF THE INVENTION

1. Field of the Invention

The present invention relates to a back pressure regulating valve and an electric type of a scroll compressor with the same.

2. Description of the Related Art

A general scroll compressor applied to a refrigerating cycle of a refrigerator may have a structure shown in FIG. 3. The scroll compressor comprises a fixed scroll 31; an orbiting scroll 32 performing an orbiting motion relative to the fixed scroll 31; a discharging volume 33 for discharging a compressed refrigerant; an inlet 34 where the refrigerant enters; a motor 36 for rotating the orbiting scroll 32; and a shaft 36*b* for rotating the orbiting scroll 32 by an operation of the motor 36*a*. And also, the scroll compressor may comprise a back pressure hole 351 and/or a discharging hole 352 for regulating a pressure between a compressing chamber and a back pressure chamber 35. In case of such an electric scroll compressor, a back pressure chamber 35 should be formed at a rear surface of a head plate of the orbiting scroll 32 in order that a leakage may be minimized at a gap between the fixed scroll 31 and the orbiting scroll 32 paired with the fixed scroll 31 to form the compressing chamber through the orbiting motion and to compress a gas. An axial component of the gas force formed within the compressing chamber pushes the orbiting scroll 32 from the fixed scroll 31 to increase the axial gap between two scrolls 31, 32, and therefore, the orbiting scroll 32 is pushed to the fixed scroll 31 by an internal pressure of the back pressure chamber 35 to generate a back pressure force decreasing the shaft directional gap, if the back pressure chamber 35 is formed at the rear surface of the head plate of the orbiting scroll 32. In such a case, if the back pressure is smaller than the axial gas force, then the orbiting scroll 32 may be separated away from the fixed scroll 31, whereas if the back pressure is greater than the axial gas force, then the orbiting scroll 32 moves to the fixed scroll 31 and two scrolls 31, 32 contact closely. This close contact may generate a frictional loss between two scrolls 31, 32, and as the back pressure increases, the frictional loss increases. Therefore, it is necessary for a proper level of the back pressure to be made in order that the axial gap between two scrolls 31, 32 is minimized and at the same time the frictional loss is not increased above a predetermined level. According to a known skill for forming the back pressure of the back pressure chamber 35, the compressing chamber at the front surface of the head plate is connected by a passage to the back pressure chamber 35 at the rear surface of the head plate by forming the back pressure hole 351 at the head plate of the orbiting scroll. In such case, the gas within the compressing chamber enters the back pressure chamber 35 through the back pressure hole 351, and a pressure within the back pressure chamber may be formed. The level of the gas pressure of the back pressure chamber 35 depends on a position of the back pressure hole 351, and the closer the back pressure hole 351 is to a centering part of the orbiting scroll 32, the higher pressure gas flows into the back pressure chamber 35. Such back pressure hole method has a simple structure, but if the running condition changes, then a proper back pressure corresponding to the running condition may not be formed resulting in an excessive back pressure or an insufficient back pressure.

As another method for forming the back pressure of the back pressure chamber, the back pressure hole 351 is not formed on the surface of the head plate, but formed within a wrap along a height of the wrap corresponding to an axial direction from a front end surface of the orbiting scrolling wrap centering part to a rear surface of the orbiting scroll head plate where the wrap is mounted vertically. In such case, if the back pressure of the back pressure chamber is sufficient, then the front surface of the orbit scroll wrap is in close contact with the surface of the fixed scroll head plate, and a sliding orbiting motion is performed on the fixed scroll head plate in a condition that the axial gap is minimized. If the running condition changes and the back pressure becomes insufficient, then the orbiting scroll is separated away from the fixed scroll in the axial direction, and such separation may make a gap flow passage where the inlet of the back pressure hole formed at the front end surface of the orbiting scroll wrap centering part is separated at the fixed scroll head plate surface. As a result, the high pressure gas within the compressing chamber located at the centering part flows into the back pressure chamber after flowing into the back pressure hole through the inlet of back pressure hole opened like this. Such inflow of the high pressure gas makes the pressure of the back pressure chamber increase, and then the back pressure becomes greater than the gas force along the axial direction to push up the orbiting scroll toward the fixed scroll again. On the contrary, when the running condition changes such as a decrease of the discharging pressure or the suction pressure, the excessive back pressure should be relieved appropriately, but it has a disadvantage in that a proper back pressure decrease is not performed rapidly. In regard to regulation of the gap between the fixed scroll and the orbiting scroll, international publication number WO 2010/064537 discloses a scroll compressor including an inlet communicating with a compressing chamber, an outlet communicating with a back pressure chamber, and a communicating hole for forming communication between the inlet and the outlet. But, the prior art has a disadvantage discussed above. Therefore, it is necessary for a method for supplying a back pressure to be developed, wherein a response to the change of the running condition can be made quick, the gap between the fixed scroll and the orbiting scroll can be made to be minimized, and at the same time an excess of the frictional loss can be prevented by the method. But the prior art doesn't discuss such a method.

The present invention is to solve the problems of the prior art and has the following object.

PURPOSE OF THE INVENTION

An object of the present invention is to provide a back pressure regulating valve and an electric type of a scroll compressor with the same capable of providing an optimal back pressure value of a back pressure chamber according to a change of a running condition.

SUMMARY OF THE INVENTION

In one embodiment of the present invention, a valve of an electric scroll compressor for regulating a back pressure comprises a valve housing including a first housing, a second housing and a communicating passage for connecting the first housing to the second housing; and a piston including a first piston located within the first housing, a second piston located within the second housing and a connecting rod for connecting the first piston to the second piston, wherein the piston is configured to move up and down within the first and the second housing.

In other embodiment of the present invention, the cross sectional size of the second housing is bigger than that of the first housing.

In another embodiment of the present invention, a first housing upper cylinder is connected to a discharging chamber, a first housing lower cylinder is connected to a back pressure chamber, a first back pressure chamber communicating passage is formed at a side of the first housing for the first housing upper cylinder to communicate with a back pressure chamber when the piston reaches at a bottom dead center, a second upper cylinder is connected to a suction chamber and a second lower cylinder is connected to the back pressure chamber, and a first suction chamber communicating passage is formed at a side of the second housing for the second housing lower cylinder to communicate with the suction chamber when the piston reaches at a top dead center.

In still another embodiment of the present invention, the valve further comprises elastic units installed at the first housing and the second housing for limiting a movement of the first piston and the second piston and at the same time for supplying a restoring force.

In still another embodiment of the present invention, a pressure ratio is represented as rp=(A2−A0)/A1, wherein A0, A1 and A2 are cross sectional sizes of the connecting rod, the first piston and the second piston, respectively.

In still another embodiment of the present invention, a scroll compressor comprises a fixed scroll; an orbiting scroll for orbiting around the fixed scroll; a back pressure chamber formed at a rear surface of a head plate of the orbiting scroll; and a valve for regulating a back pressure described above.

The valve for regulating the back pressure according to the present invention provides an optimal back pressure for being optimized to the axial direction response of the orbiting scroll according to the discharging pressure and the suction pressure, and thereby the leakage between the fixed scroll and the orbiting scroll and the frictional loss can be minimized. The valve for regulating the back pressure according to the present invention can keep the pressure of the back pressure chamber to a predetermined level by an opening and closing of the back pressure passage and the suction pressure passage according to the up and down movement of the piston and the position of the piston corresponding to the result of the response to various changes of the running condition such as an increase or decrease of a discharging pressure and an increase or decrease of the suction pressure. The scroll compressor according to the present invention may apply to a compressor of a refrigerator to provide a high efficient compressing function that the leakage and the frictional loss are minimized.

DETAILED DESCRIPTION OF EXEMPLARY EMBODIMENTS

Exemplary embodiments of the present invention will be described herein below with reference to the accompanying drawings.

Figure 1:
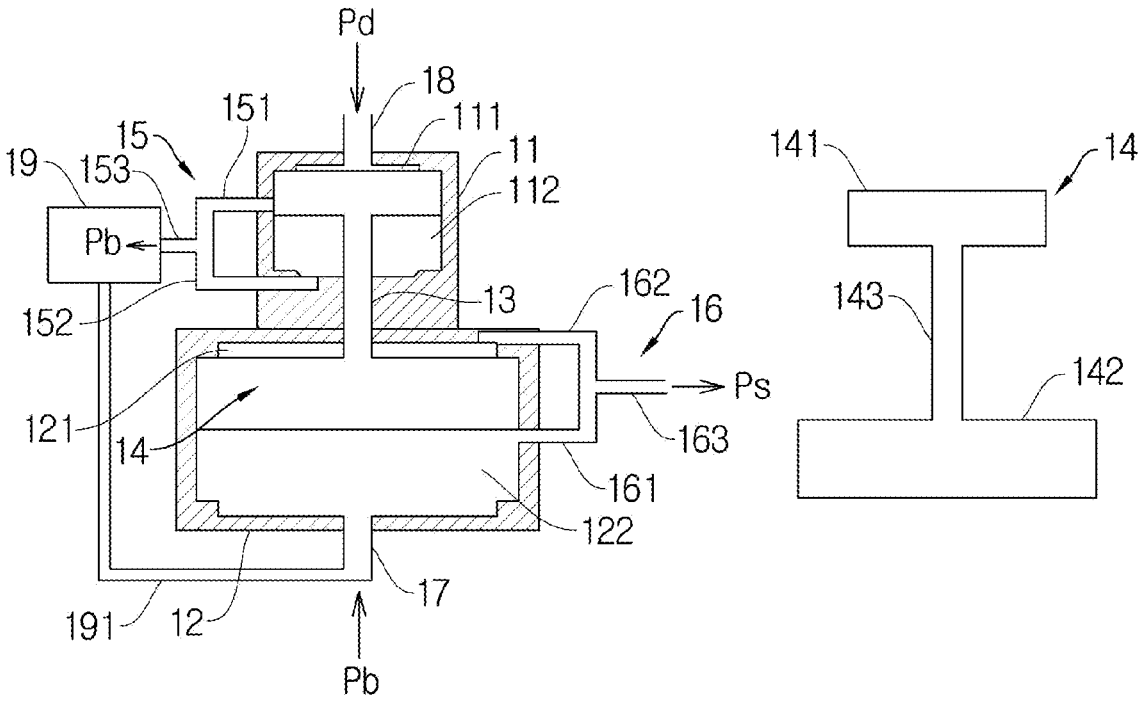
FIG. 1 shows an embodiment of a valve for regulating a back pressure according to the present invention.

FIG. 1 shows an embodiment of a valve for regulating a back pressure according to the present invention.

Referring to FIG. 1, a valve of an electric scroll compressor for regulating a back pressure comprises a valve housing including a first housing 11, a second housing 12 and a communicating passage 13 for connecting the first housing 11 to the second housing 12; and a piston 14 including a first piston 141 located within the first housing 11, a second piston 142 located within the second housing 12 and a connecting rod 143 for connecting the first piston 141 to the second piston 142, wherein the piston 14 is configured move up and down within the first and the second housings 11, 12.

Specifically, the piston 14 is installed within the first and the second housings 11, 12 to move up and down, and comprises the first piston 141; the second piston 142; and the connecting rod 143 for connecting the first piston 141 to the second piston 142. The first piston 141 is located within the first housing 11; the second piston 142 is located within the second housing 12; and the piston connecting rod 143 is located in a way to penetrate the communicating passage 13. The first piston 141, the second piston 142 and the connecting rod 143 can move up and down within the first housing 11, the second housing 12 and the communicating passage 13, respectively. The first housing 11 may be a hollow cylindrical shape, and form a first receiving volume. The second housing 12 may be a hollow cylindrical shape to form a second receiving volume, and the second housing 12 may be connected to the first housing by the communicating passage 13. The first piston 141 may be a cylindrical shape to be received within the first housing 11, and the first piston 141 may move up and down within the first housing 11. The second piston 142 may be a cylindrical shape to be received within the second housing 12 for moving up and down within the second housing 12, and the second piston 142 may be connected to the first piston 141 by the connecting rod 143. The piston 14 may be received within the valve housing, and the connecting rod 143 moves up and down along the communicating passage 13, thereby the piston 14 may move up and down. The cross sectional size of the second housing 12 may be bigger than that of the first housing 11, thereby the cross sectional size of the second piston 142 may be bigger than that of the first piston 141, but the first or second housing 11, 12 or the first or second piston 141, 142 may have various cross sectional sizes, but not limited to.

The first piston 141 located within the first housing 11 may divide an inner volume of the first house 11 into two partial volumes along up and down direction. The first upper cylinder 111 may be formed at the upper volume of the first piston 141, and the first lower cylinder 112 may be formed at the lower volume of the second piston 14, respectively. The second piston 142 may divide an inner volume of the second housing 12 into two partial volumes along up and down direction. Specifically, the inner volume of the second housing 12 may be divided into the second upper cylinder 121 corresponding to an upper volume of the second piston 14 and the second housing lower cylinder 122 corresponding to a lower volume of the second piston 142, respectively. The piston 14 may move up and down depending on the force size according to a pressure distribution applied to up and down cross section of the first piston 141 and the second piston 141. A discharging pressure Pd may be always applied to the first housing upper cylinder 111, and a back pressure Pb may be always applied to the first housing lower cylinder 112. And a lower suction pressure Ps may be applied to the second housing upper cylinder 121, and the back pressure Pb may be applied to the second housing lower cylinder 122. The piston 14 moves up and down according to a change of a running condition, that is, the pressure of the suction chamber or the discharging chamber.

FIG. 2A to 2E shows an embodiment of a process for regulating a back pressure by the valve for regulating the back pressure according to the present invention.

Referring to FIG. 2A to FIG. 2E, a first and second elastic units 21, 22 such as a spring may be placed with the first housing 11 and the second housing 12. Specifically, the first elastic unit 21 may be placed at an upper part of the first housing 11, and the second elastic unit 22 may be placed at a lower part of the second housing 12, and thereby, the up and down movement of the first piston 141 and the second piston 142 may be restricted. An opening and closing of the first back pressure communicating passage 151 formed at a side part of the first housing 11 may be determined according to the position of the first piston 141 depending on the movement of the piston 14. And also, an opening and closing of the first suction chamber communicating passage 161 formed at the side part of the second housing 12 may be determined according to the position of the second piston 141. A gas with a high pressure of Pd may enter the back pressure chamber 19, or the gas of the back pressure chamber 19 may be discharged to the suction chamber through the opening and closing of the communicating passage 151, 161. The pressure of the back pressure chamber 19 may reach a predetermined back pressure value by controlling such a gas entering and discharging of the back pressure chamber 19.

Such process will be discussed in the following.

A Condition According to the Position of the Piston in FIG. 2A to FIG. 2E The positon of the piston 14 within the first housing 11 and the second housing 12 corresponds to any one among FIG. 2A to FIG. 2E.

Figure 2A:
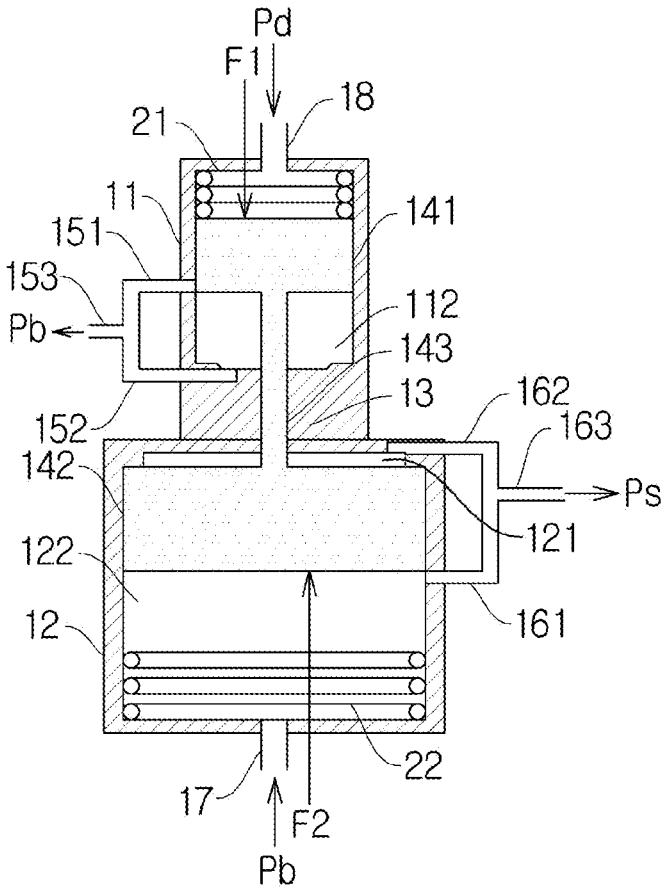
FIG. 2A to 2E shows an embodiment of a process for regulating a back pressure by the valve for regulating the back pressure according to the present invention.

FIG. 2A shows a condition that the piston 14 is located at the highest position, that is, reaches the top dead center. When the piston 14 reaches the top dead center, the first elastic unit 21 may be contracted maximally, and the second elastic unit 22 becomes a free length state in which it is not contracted at all. In this condition, the separating distance between the lower surface of the second piston 142 and the second elastic unit 22 becomes maximum. And, in this condition, the first back pressure chamber communicating passage 151 is closed and the first suction chamber communicating passage 161 is in an open state.

Figure 2B:
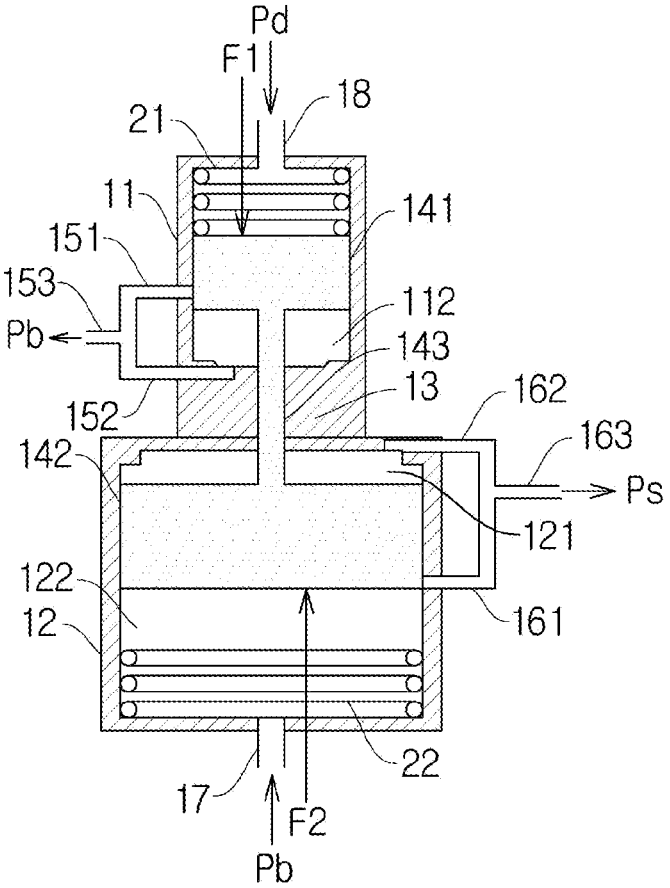

Referring FIG. 2B, the first piston 141 moves downward from the top dead enter to make the contracted displacement of the first elastic unit 21 disappear gradually, and thereby, the first elastic unit 21 becomes in a free length state. In this condition, the first back pressure chamber communicating passage 151 remains in a closed state, and the first suction chamber communicating chamber 161 is just closed. That is, the lower corner of the second piston 142 reaches the lower end of the first suction chamber communicating passage 161 to block the communicating passage 161.

Figure 2C:
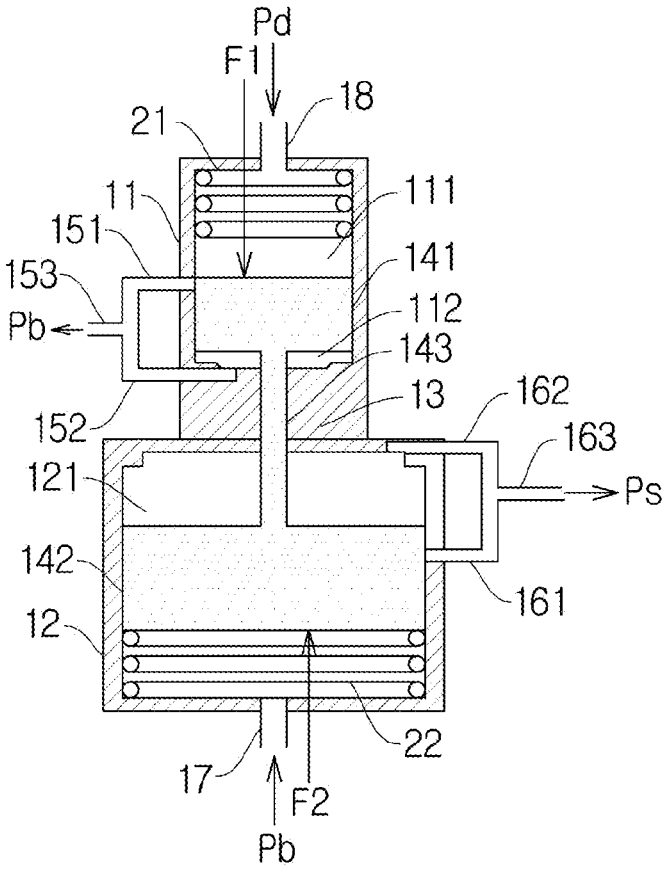

Referring to FIG. 2C, if the second piston 142 further moves downwardly, then the first piston 141 is separated from the elastic unit 21, and the second piston 142 contacts the second elastic unit 22 to remain in a free length state and to perform no contraction. In this condition, the first back pressure chamber communicating passage 151 remains in a closed state and is about to be opened, and the first suction chamber communicating passage 161 is in a closed state.

Figure 2D:
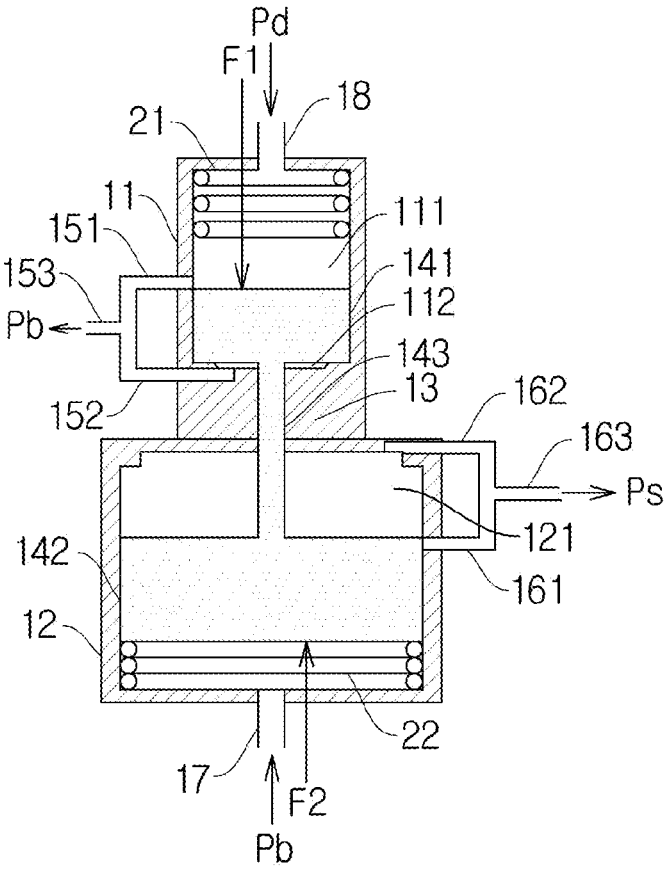

Referring to FIG. 2D, the second piston 142 moves downwardly as much as possible to reach the bottom dead center. In such condition, the second elastic unit 22 contracts maximally to become a minimum length. In this condition, the first back pressure chamber communicating passage 151 remains in an open state, and the first suction chamber communicating passage 161 remains in a closed state.

Figure 2E:
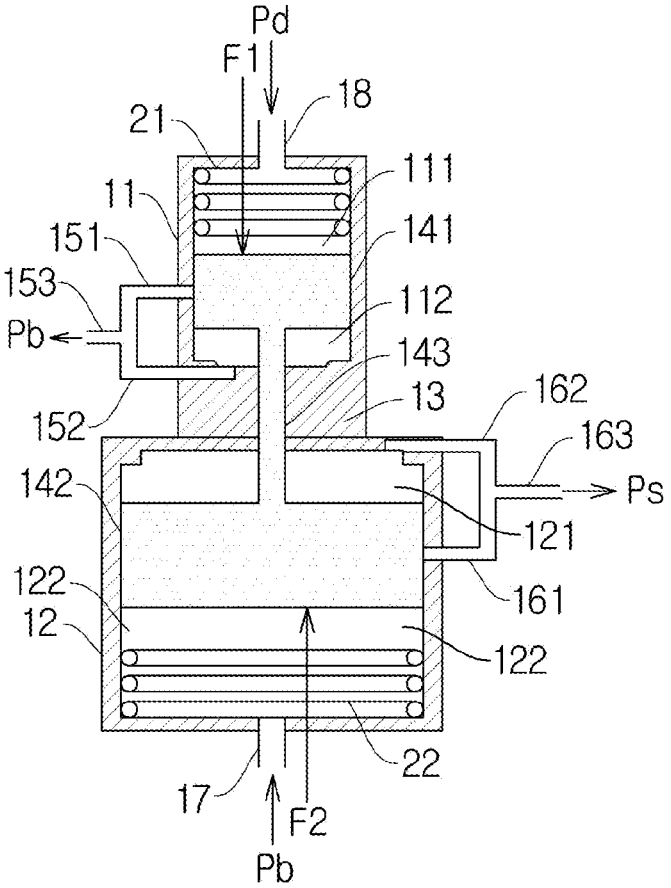
Figure 3:
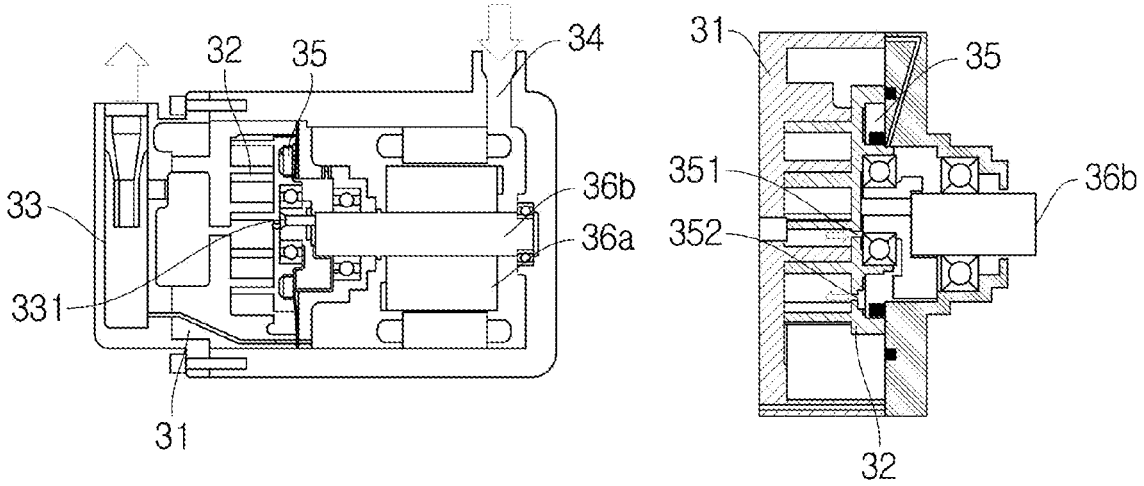
Prior Art FIG. 3
FIG. 3 shows an embodiment of a known scroll compressor.

Referring to FIG. 2E, the depicted example shows a middle state of the example of FIG. 2B and FIG. 2C, the piston 14 is separated from both of the first elastic unit 21 and the second elastic unit 22, and both of the first back pressure chamber communicating passage 151 and the first suction chamber communicating passage 161 are in a closed state.

In this course, the forces acting on the first and second piston 141, 142 are as follows. If F1 is a force acting downward on the first piston 141, F2 is a force acting upward on the second piston 142, A1, A2 and A0 become the cross section size of the first, second piston 141, 142 and the connecting rod 143, respectively, then F1 and F2 are expressed as equations (1) and (2) below.

$$F_1 = A_1 P_d - (A_1 - A_0)P_b + k_1 \Delta y_1 \quad (1)$$

$$F_2 = A_2 P_b - (A_2 - A_0)P_s + k_2 \Delta y_2. \quad (2)$$

In equation (1) and (2), k1 and Δy1 are the elastic coefficient and the contracted length of the first elastic unit 21 fixed at the upper surface of the first housing 11, and k2 and Δy2 are the elastic coefficient and the contracted length of the second elastic unit 22 fixed at the lower surface of the second housing 12.

In FIGS. 2B, 2C and 2E, each elastic unit 21, 22 is in a free length state having no displacement, therefore Δy1=Δy2-0, and thereby, F1 and F2 may be expressed as equations (3) and (4) below.

$$F_1 = A_1 P_d - (A_1 - A_0)P_b \quad (3)$$

$$F_2 = A_2 P_b - (A_2 - A_0)P_s \quad (4)$$

And also, force F1 acting on the first piston 141 and force F2 acting on the second piston F2 is in an equilibrium state to be expressed as F1=F2, and the following equation (5) is established.

$$A_1 P_d - (A_1 - A_0)P_b = A_2 P_b - (A_2 - A_0)P_s \quad (5)$$

If equation (5) is rearranged, then equation (6) below is derived.

$$A_1(P_d - P_b) = (A_2 - A_o)(P_b - P_s) \quad (6)$$

If the back pressure chamber pressure ratio rp is defined as equation (7) below, $$r_p = \frac{P_d - P_b}{P_b - P_s} \tag{7}$$

The back pressure chamber pressure ratio rp is expressed as following equation (8) from equation (6).

$$r_p = \frac{P_d - P_b}{P_b - P_s} = \frac{A_2 - A_0}{A_1} \tag{8}$$

In equation (8), the back pressure chamber pressure ratio rp is determined by the cross sectional size A1 of the first piston 141, the cross sectional size A2 of the second piston 142 and the cross sectional size A0 of the connecting rod 143. Therefore, if the cross sectional size of the first and second piston 141, 142 and the connecting rod 143 are determined, the pressure ratio becomes a constant value from the equation (8) above.

And also, the back pressure (Pb) may be expressed as the following equation (9).

$$P_b = \frac{P_d + r_p P_s}{1 + r_p} \tag{9}$$

The back pressure regulating valve according to the present invention operates in a way that the back pressure of the back pressure chamber has a value to satisfy the equation (9) when the discharging pressure Pd and the suction pressure Ps corresponding to the running condition changes.

The piston 14 moves in a way that the back pressure reaches a value corresponding to the equation (9), and then the piston 14 may be placed at the position shown in FIG. 2B or in FIG. 2C, or may be placed at a position shown in FIG. 2E corresponding to any position located between the positions shown in FIG. 2B and in FIG. 2C. At this position, the first back pressure chamber communicating passage 151 and the suction chamber communicating passage 161 is in a closed stage, and the force F1 acting on the first piston 141 and the force F2 acting on the second piston 142 are in an equilibrium condition.

The following is a detailed description of the piston motion of the back pressure regulating valve operating together according to the change of the running condition and a process of reaching a predetermined back pressure and of achieving an equilibrium condition on reaching the predetermined back pressure.

The change of the running condition may comprise an increase or a decrease of the discharging pressure; and an increase or a decrease of suction pressure.

A. Discharging Pressure Increase

If the discharging pressure Pd increases because of the change of the running condition, then the back pressure Pb increases according to the equation (9) as in the following description.

If the discharging pressure Pb increases in any state out of the states shown in FIG. 2B, 2C or 2E corresponding to a force equilibrium state of the piston 14, then F1 increases in the equation (3) to become F1>F2. Accordingly, the piston 14 moves downward to approach to a position shown in FIG. 2D after passing a positon shown in FIG. 2C. If the piston 14 moves below the positon shown in FIG. 2C, then a reacting force k2Δy2 of the second elastic unit 22 may be generated. But if the reacting force is set as much smaller than the gas force increment (the gas force generally is much greater than the reacting force of the first and second elastic unit 21, 22), then F1>F2 finally owing to the increase of the discharging pressure Pd. That is, even though the discharge pressure increases a little, F1>F2 and the piston may reach the bottom dead center shown in FIG. 2*d*. The first back pressure chamber communicating passage 151 is opened at the moment when the piston passes the position shown in FIG. 2C, and the discharging pressure gas filled in the first housing upper cylinder 111 enters the back pressure chamber through the first back pressure chamber communicating passage 151 to increase the pressure of the pack pressure chamber.

If the pressure of the back pressure chamber increases, then F1 decreases in the equation (3) and F2 increases in the equation (2). Even though the back pressure increases in a state of F1>F2, the first back pressure chamber communicating passage 151 remains in an open state continuously to increase the back pressure continuously. Finally, the condition reaches a state that F2 is nearly equal to F1 or the moment when F1<F2 by a narrow margin for reversing from a state of F1>F2, and at this moment, the piston 14 moves upward until the first back pressure chamber communicating passage 151 is closed.

When the piston 14 is placed in a position between the positions shown in FIG. 2C and FIG. 2D, an elastic reaction force by a displacement of the second elastic unit 22 may be generated. The role of the reaction force is to move the piston upwardly when the force equilibrium in up and down direction by the pressure difference of a pure gas acting on the piston 14 is minute. That is, the reaction force helps to restore the force equilibrium by acting in a direction to close the first back pressure chamber communicating passage 151. The role of the first and second elastic unit 21, 22 may be identical to all the following cases.

Finally, the piston 14 reaches a new equilibrium state, and the back pressure Pb becomes a predetermined back pressure value satisfying the equation (9) in a new running condition. The piston 14 is placed at a position between the positions shown in FIGS. 2B and 2C, that is, a position such as the positon shown in FIG. 2E.

B. Discharging Pressure Decrease

If discharging pressure Pd decreases because of the change of the running condition, then the back pressure Pb decreases according to the equation (9) as discussed in the following.

If the discharging pressure Pd decreases in a state that the piston 14 is placed at a positon among the positions shown in FIG. 2B, 2C or 2E corresponding to a force equilibrium state, then F1 decreases to become F1<F2. Accordingly, the piston 14 moves upward to approach to the position shown in FIG. 2A via the position shown in FIG. 2B. If the piston 14 approaches to the position shown in FIG. 2A, then a reaction force k1Δy1 of the first elastic unit 21 may be generated. However, the reaction force is set as little as possible compared with the increment of the gas force. That is, if the discharging pressure Pd decreases by a minute amount, then the state becomes F1>F2 and the piston 14 reaches the bottom dead center shown in FIG. 2A via the positon shown in FIG. 2B. The back pressure gas filled in the second housing lower cylinder 122 flows to the suction chamber through the first suction chamber communicating passage 161 which is opened at the moment when the piston 14 passes the position shown in FIG. 2B, and the pressure of the back pressure chamber decreases. If the pressure of the back pressure chamber decreases, then F1 increases in the equation (1), and F2 decreases in the equation (4). Such decrease of the back pressure continues till the first suction chamber communicating passage 161 is in an open state, finally F2 is nearly equal to F1 or a moment when the force is reversed as F1>F2 by a narrow margin arrives, and at this time, the piston 14 moves downward continuously till the first suction chamber communicating passage 161 is closed. In this time, the reaction force of the first elastic unit 21 helps the piston 14 to move downward. In this condition, the piston 14 reaches a new equilibrium state, and the back pressure Pb becomes a new set back pressure value satisfying the equation (9) in a new running condition. The piston 14 is placed again at the positon between positions shown in FIGS. 2B and 2C, that is, the position shown in FIG. 2E.

C. Suction Pressure Increase

If the suction pressure Ps increases because of the change of the running condition, then the back pressure Pb increases according to the equation (9) as discussed in the following.

If the suction pressure Ps increases in a state that the piston 14 is placed at a positon among the positions shown in FIG. 2B, 2C or 2E corresponding to a force equilibrium state, then F2 in the equation (4) decreases to become F1>F2. Accordingly, the piston 14 moves downward to approach to the position shown in FIG. 2D via the position shown in FIG. 2C. If the piston 14 moves to a lower positon than the position shown in FIG. 2C, a reaction force k2Δy2 of the second elastic unit 22 may be generated.

The discharging pressure gas filled in the first housing upper cylinder 111 enter the back pressure chamber through the first back pressure chamber communicating passage 151 which starts to open at the moment when the piston 14 passes the positon shown in FIG. 2C, and the pressure of the back pressure chamber increases.

If the pressure of the back pressure chamber increases, then F1 decreases in the equation (3), and F2 increases in the equation (2). Finally, F2 is nearly equal to F1 or a moment when the force is reversed as F1<F2 minutely arrives, and at this time, the piston 14 moves upward continuously till the first back pressure chamber communicating passage 151 is closed. In this time, the reaction force of the second elastic unit 22 helps the piston 14 to move upward.

Finally, the piston 14 reaches a new equilibrium state, and the back pressure Pb becomes a new set back pressure value satisfying the equation (9) in a new running condition. The piston 14 is placed again at the positon between positions shown in FIGS. 2B and 2C, that is, the position shown in FIG. 2E.

D. Suction Pressure Decrease

If the suction pressure Ps decreases because of the change of the running condition, then the back pressure decreases according to the equation (9) as discussed in the following.

If the discharging pressure Ps decreases in a state that the piston 14 is placed at the positon out of the positions shown in FIG. 2B, 2C or 2E corresponding to a force equilibrium state, then F2 increases to become F1<F2. Accordingly, the piston 14 moves upward to approach to a position shown in FIG. 2A via the position shown in FIG. 2B. If the piston approaches to the positon shown in FIG. 2C, a reaction force k1Δy1 of the first elastic unit 21 may be generated.

The back pressure gas filled in the second housing lower cylinder 122 enters the suction chamber through the first suction chamber communicating passage 161 which starts to open at the moment when the piston 14 passes the positon shown in FIG. 2B, and the pressure of the back pressure chamber decreases.

If the pressure of the back pressure chamber decreases, then F1 increases in the equation (1), and F2 decreases in the equation (4). Such back pressure decrease continues until the first suction chamber communicating passage 161 is in an open state. And then, F2 is nearly equal to F1 or a moment when the force is reversed as F1>F2 minutely arrives, and at this time, the piston 14 moves downward continuously till the first suction chamber communicating passage 161 is closed. In this time, the reaction force of the first elastic unit 21 helps the piston 14 to move downward.

Finally, the piston 14 reaches a new equilibrium state, and the back pressure Pb becomes a new set back pressure value satisfying the equation (9) in a new running condition. The piston 14 is placed at the positon between positions shown in FIGS. 2B and 2C, that is, the position shown in FIG. 2E.

As shown above, the back pressure regulating valve according to the present invention may make the back pressure have always a value given by the equation (9) regardless of various changes of the running condition such as an increase or a decrease of the discharging pressure, or an increase or decrease of the suction pressure. If the discharging pressure Pd and the suction pressure Ps are given in the equation (9), the back pressure Pb is determined according to the pressure ratio rp. However, the pressure ratio rp defined in the equation (8) has a fixed value determined by the cross sectional sizes A1, A2 of the first piston 141 and second piston 142 corresponding to the shape dimension of the piston and the cross sectional size A0 of the connecting rod 143.

For example, if the diameter of the first piston 141 is 5 mm, the diameter of the second diameter is 7.35 mm, and the diameter of the connecting rod 143 is 2 mm, then the pressure ration (rp) becomes 2.0 and is expressed as the equation (10) below.

$$\frac{P_d - P_b}{P_b - P_s} = 2.0 \tag{10}$$

If rp=2.0, then the back pressure is expressed as the equation (11) below.

$$P_b = (P_d + 2P_s)/3 \tag{11}$$

The first piston 141, the second piston 142 and the connecting rod 143 may have various values, but not limited to.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. A valve of an electric scroll compressor for regulating a back pressure, comprising:

a valve housing including a first housing, a second housing and a communicating passage for connecting the first housing to the second housing; and a piston including a first piston located within the first housing, a second piston located within the second housing and a connecting rod for connecting the first piston to the second piston, wherein the piston is configured to move up and down within the first and the second housing, wherein the cross sectional size of the second housing is bigger than that of the first housing, and wherein a first housing upper cylinder is connected to a discharging chamber, a first housing lower cylinder is connected to a back pressure chamber, a first back pressure chamber communicating passage is formed at a side of the first housing for the first housing upper cylinder to communicate with a back pressure chamber when the piston reaches at a bottom dead center, a second upper cylinder is connected to a suction chamber and a second lower cylinder is connected to the back pressure chamber, and a first suction chamber communicating passage is formed at a side of the second housing for the second housing lower cylinder to communicate with the suction chamber when the piston reaches at a top dead center.

2. The valve according to claim 1, further comprising elastic units installed at the first housing and the second housing for limiting a movement of the first piston and the second piston and at the same time for supplying a restoring force.

3. The valve according to claim 1, wherein a pressure ratio is represented as rp=(A2−A0)/A1, wherein A0, A1 and A2 are cross sectional sizes of the connecting rod, the first piston and the second piston, respectively.

4. A scroll compressor, comprising:

a fixed scroll;

an orbiting scroll for orbiting around the fixed scroll;

a back pressure chamber formed at a rear surface of a head plate of the orbiting scroll; and a valve for regulating a back pressure according to claim 1.

5. A scroll compressor, comprising:

a fixed scroll;

an orbiting scroll for orbiting around the fixed scroll;

a back pressure chamber formed at a rear surface of a head plate of the orbiting scroll; and a valve for regulating a back pressure according to claim 2.

6. A scroll compressor, comprising:

a fixed scroll;

an orbiting scroll for orbiting around the fixed scroll;

a back pressure chamber formed at a rear surface of a head plate of the orbiting scroll; and a valve for regulating a back pressure according to claim 3.

* * * * *